US007686185B2

(12) United States Patent
Zychinski

(10) Patent No.: US 7,686,185 B2
(45) Date of Patent: Mar. 30, 2010

(54) DISPENSER TRAY FOR A VENDING MACHINE

(75) Inventor: Steven M. Zychinski, St. Louis, MO (US)

(73) Assignee: Coin Acceptors, Inc., St. Louis, MO (US)

( * ) Notice: Subject to any disclaimer, the term of this patent is extended or adjusted under 35 U.S.C. 154(b) by 748 days.

(21) Appl. No.: 11/421,935

(22) Filed: Jun. 2, 2006

(65) Prior Publication Data

US 2006/0273104 A1 Dec. 7, 2006

Related U.S. Application Data

(60) Provisional application No. 60/701,269, filed on Jul. 21, 2005, provisional application No. 60/686,729, filed on Jun. 2, 2005.

(51) Int. Cl.

| | |
|---|---|
| ***B65H 1/08*** | (2006.01) |
| ***B65H 3/44*** | (2006.01) |
| ***G07F 11/16*** | (2006.01) |
| ***G07F 11/00*** | (2006.01) |

(52) U.S. Cl. ..... 221/279; 221/226; 221/75; 221/129; 221/2; 221/21; 221/124; 221/280; 221/9; 221/184; 221/175; 221/127; 221/231; 211/59.3; 312/48

(58) Field of Classification Search ..... 221/124, 221/2, 21, 59.3, 231, 127, 280, 175, 184, 221/9, 129, 75, 226, 279; 312/48
See application file for complete search history.

(56) References Cited

U.S. PATENT DOCUMENTS

| | | | | |
|---|---|---|---|---|
| 2,652,154 | A | 9/1953 | Stevens | |
| 4,858,743 | A | 8/1989 | Paraskevakos et al. | |
| 5,121,854 | A | 6/1992 | Trouteaud et al. | |
| 6,230,932 | B1 * | 5/2001 | Lowing et al. | 221/280 |
| 6,499,627 | B2 | 12/2002 | Arai | |
| 6,556,889 | B2 * | 4/2003 | Rudick et al. | 700/244 |
| 6,604,652 | B1 * | 8/2003 | Trautwein | 221/124 |
| 6,755,322 | B1 * | 6/2004 | Herzog et al. | 221/123 |
| 7,086,560 | B2 | 8/2006 | Shioya | |

FOREIGN PATENT DOCUMENTS

| | | |
|---|---|---|
| EP | 1256912 | 11/2001 |
| WO | 9949429 | 9/1999 |

OTHER PUBLICATIONS

PCT/US2006/021408 Written Opinion and Search Report with References dated Nov. 3, 2006.

(Continued)

*Primary Examiner*—Gene O. Crawford
*Assistant Examiner*—Rakesh Kumar
(74) *Attorney, Agent, or Firm*—Polster, Lieder, Woodruff & Lucchesi, LC

(57) ABSTRACT

A tray for a product vending machine including a flat base upon which product to be vended may be placed. A plurality of walls are attached to the base which define rows into which product is organized. A channel within the flat base houses a threaded shaft. The threaded shaft threadingly attaches to a product drive member.

14 Claims, 11 Drawing Sheets

OTHER PUBLICATIONS

International Search Report for Int'l Application No. PCT/US2006/021408 (5 pages).
Written Opinion of the Int'l Searching Authority for Application No. PCT/US006/021408 (8 pages).
International Search Report (Sep. 20, 2007).
Written Opinion of International Search Report (Sep. 20, 2007).
U.S. Appl. No. 11/490,595, filed Jul. 2106 by Richard G. Coppola et al; for Dispenser Tray for A Vending Machine.
U.S. Appl. No. 60/777,160, filed Feb. 27, 2006 by Joseph L. Levasseur; for Product Dispenser for a Vending Machine.

* cited by examiner

DISPENSER TRAY FOR A VENDING MACHINE

RELATED APPLICATIONS

The present application claims priority to U.S. Provisional Patent Application Ser. Nos. 60/701,269 filed Jul. 21, 2005 and 60/686,729 filed Jun. 2, 2005. The contents of said applications are hereby incorporated by reference.

BACKGROUND OF THE INVENTION

In the past, vending machines have been used to dispense beverages. In one common configuration, cans or glass or plastic bottles are stacked in a vertical or offset-vertical columns and dispensed from the bottom of the columns into a holding area below the columns where the customer can retrieve the beverage. Generally, a funnel-type diverter will be used to divert the beverage to the location of the holding area and also to prevent the beverage container from being damaged during the drop. This configuration requires that the column be shorter than the height of the machine so that the beverage can be dropped into the holding area below the columns As a result, storage space that could be used to increase capacity is wasted on the holding area. This is undesirable because in the vending industry it is preferable to have the maximum capacity of product in a machine of a given size in order to maximize sales and maximize the time between product restocking.

Additionally, vending machines incorporating products, typically snacks and candy, have utilized trays having horizontal columns of product placed between each revolution of a helical shaft. The shaft is rotated one revolution, which causes an item near the end of the screw to be forced forward and become disassociated from the helical shaft. Typically, the product will drop from the front of the tray into a holding area that can be accessed by the customer to retrieve the item. The holding area must be lower than the lowest tray so that an item may drop into the holding area. As a result, space associated with the holding area is not used for storing product, thus wasting some usable space. Moreover, the helical shaft is not particularly suited for beverage containers.

Another type of vending machine, such as that shown in U.S. Pat. No. 6,556,889 to Rudick et al., uses an elevator to receive product that is dropped from sloping trays. The product slides down the sloped trays by the force of gravity into the elevator that is moveable to a location adjacent the tray. An actuator located between the lowermost beverage and the elevator selectively allows a beverage to pass into the elevator. The elevator then moves to a second location whereby a conveyor belt in the elevator conveys the beverage to one side of the elevator where it is conveyed into a holding area to the side of the elevator. However, because the vending machine of the '889 patent utilizes sloped shelves, some of the vertical capacity of the vending machine is wasted. Moreover, because product dispensation relies on sloping shelves, jamming of product can occur if the slope is insufficient to allow for simultaneous movement of the column of product (particularly if product spillage occurs causing sticky trays) or of the product is heavy (such as large glass bottles) and applies too much force to the product dispensation actuator.

Therefore, there is a need for a vending machine, particularly a beverage vending machine, that does not waste space for a holding area for delivery of the product or for product trays that require the tray to be sloping for delivery of the product to the consumer.

SUMMARY OF THE INVENTION

The present invention provides a tray for a product vending machine comprising a flat base upon which product to be vended may be placed. A plurality of walls are attached to the base which define rows into which product is organized. A channel within the flat base houses a threaded shaft. The threaded shaft threadingly attaches to a product drive member.

DESCRIPTION OF THE PREFERRED EMBODIMENT

Figure 1:
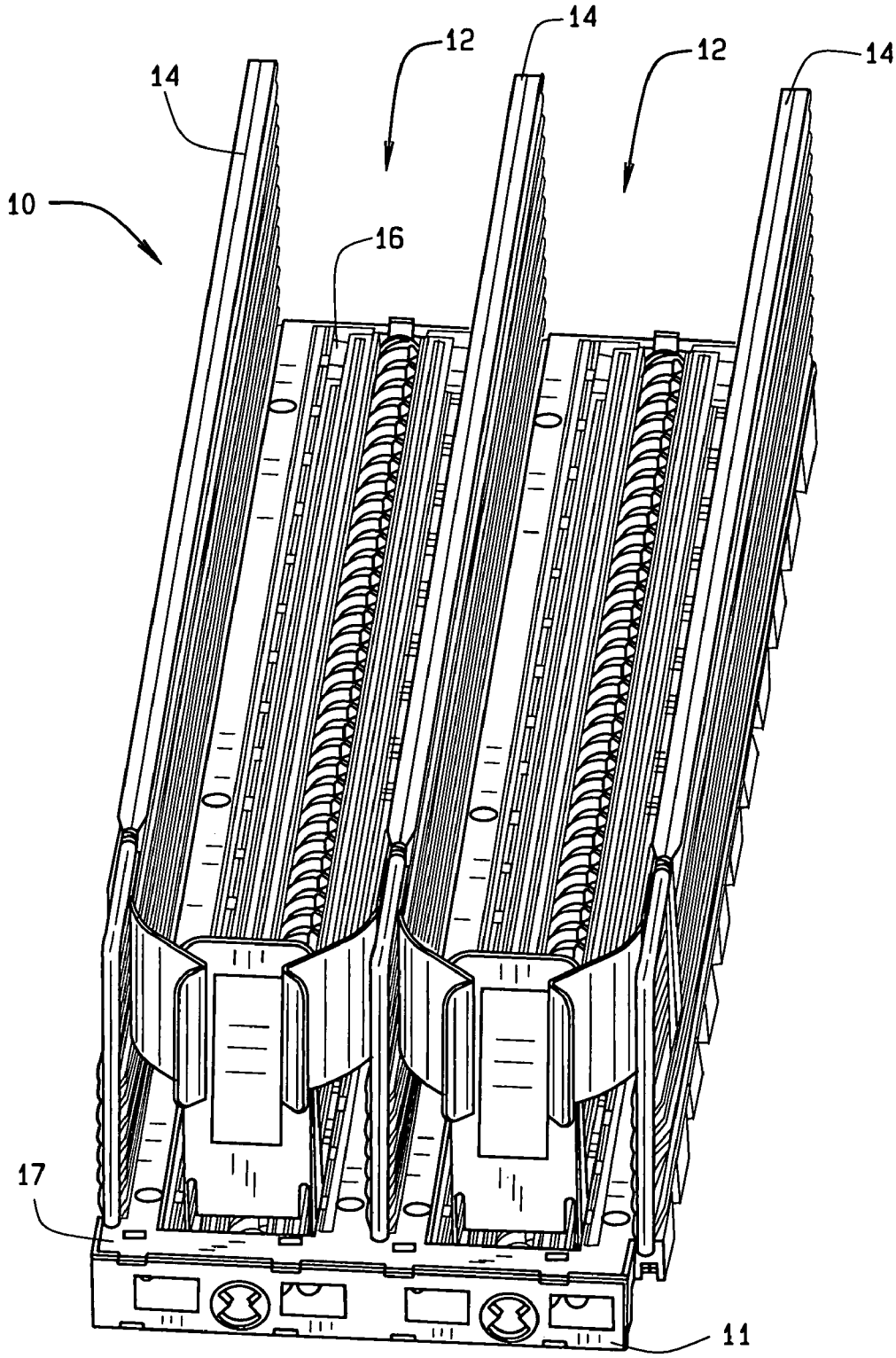
FIG. 1 is a front perspective view of a vending machine tray according to an embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
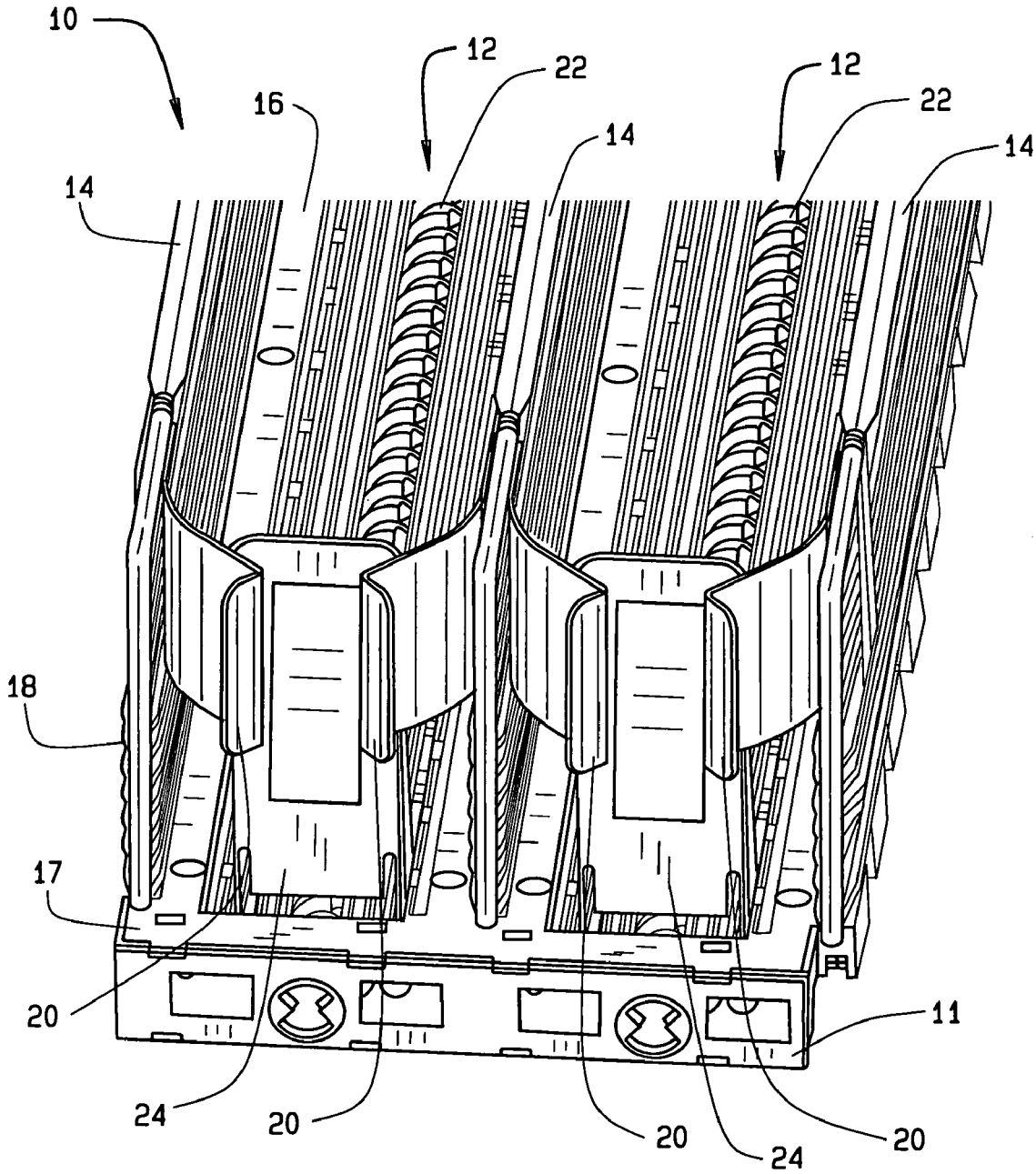
FIG. 2 is an enlarged partial view of the vending machine tray of FIG. 1.

Referring to FIG. 1, the present invention is a vending machine dispenser tray 10. The tray 10 is most suited for vending beverage items such as soda, water, juices, etc. although nothing prevents application of this invention to non-beverage items. The tray 10 has a front 11 and comprises rows 12 that are defined by upstanding walls 14 attached to a base 16 having a front 17. As shown in FIG. 2, at an end 18 of the walls 14 is attached a pair of resilient arms 20. Two resilient arms 20 extend from each wall 14, such that a pair of arms 20 from adjacent walls 14 cooperate to at least partially block the end of each row 12. Located within a channel 13 formed within each row 12 of the base 16 is a threaded shaft 22 that is threaded into a product backstop or drive member 24.

Figure 3:
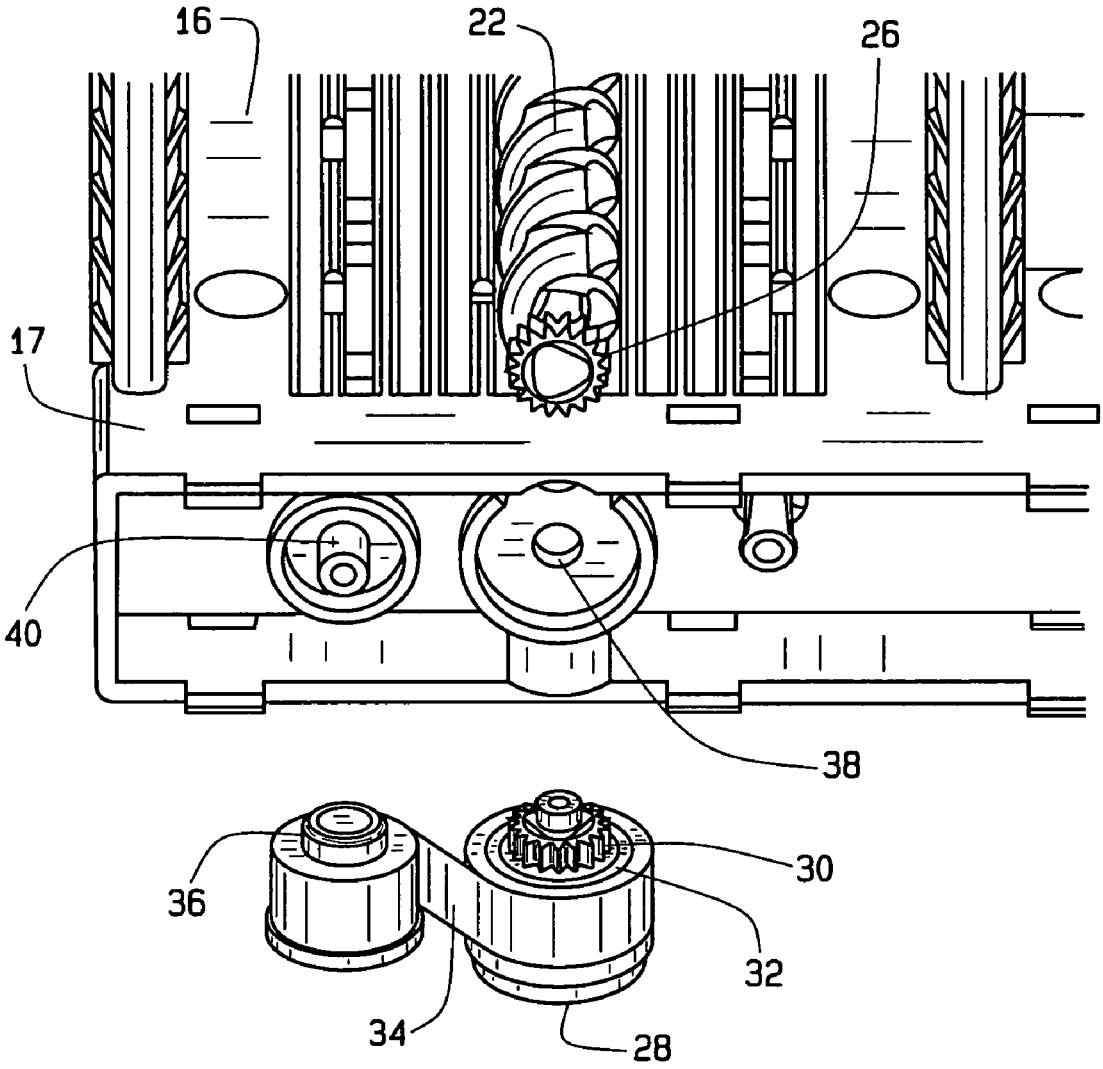
FIG. 3 is a front perspective view of a partially disassembled vending machine tray according to an embodiment of the present invention.
Figure 4:
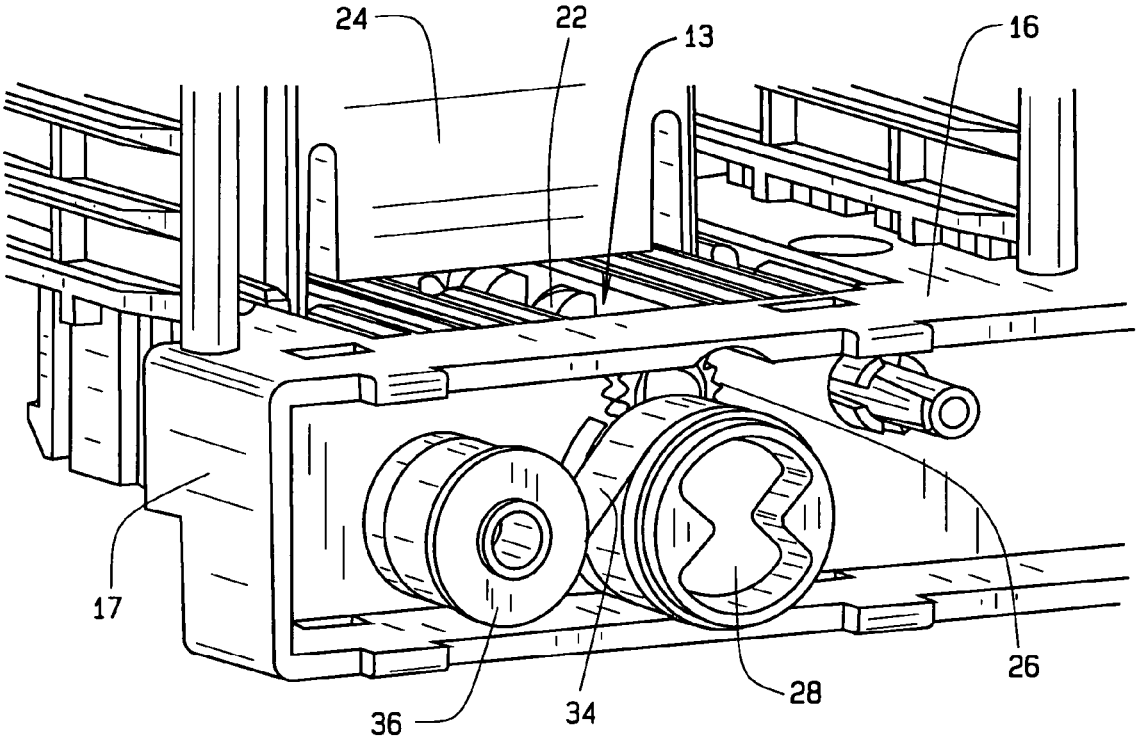
FIG. 4 is a front perspective view of a partially assembled vending machine tray according to an embodiment of the present invention.

FIGS. 3 and 4 show that each threaded shaft 22 has a gear 26 that is located near the front 17 of the base 16. Each gear 26 is driven by a rotatable drive shaft 28 having a mating gear 30. The drive shaft 28 further defines a smooth outer surface 32. Also provided in the front 17 of the base 16 and adjacent the drive shaft 28 is a linear coil spring 34 wrapped around a rotatable spring shaft 36. An end of the spring 34 is attached to the drive shaft 28, and the other end of the spring 34 is attached to the spring shaft 36. The drive shaft 28 and spring shaft 36 are mounted to the base 16 into a drive shaft hole 38 and onto a spring shaft pin 40, respectively. As the drive shaft 28 is rotated clockwise, the spring 34 is wrapped around the smooth outer surface 32 of the drive shaft 28 and the spring shaft 36 is rotated counterclockwise as the spring 34 uncoils. However, because the spring 34 is wrapped around the drive shaft 28 in the opposite direction to the spring shaft 36, the natural bias of the spring 34 causes the spring 34 to resist being wrapped onto the drive shaft 28. Therefore, the natural bias of the spring 34 urges the drive shaft 28 counterclockwise.

As discussed above, the product drive member 24 is threaded onto the threaded shaft 22. Because the drive shaft 28 is urged counterclockwise, the drive shaft 28 urges the threaded shaft 22 clockwise through the mating gears 26 and 30. The result of the threaded shaft 22 being urged clockwise is that the product drive member 24 is urged to the front 11 of the row 12.

Figure 5:
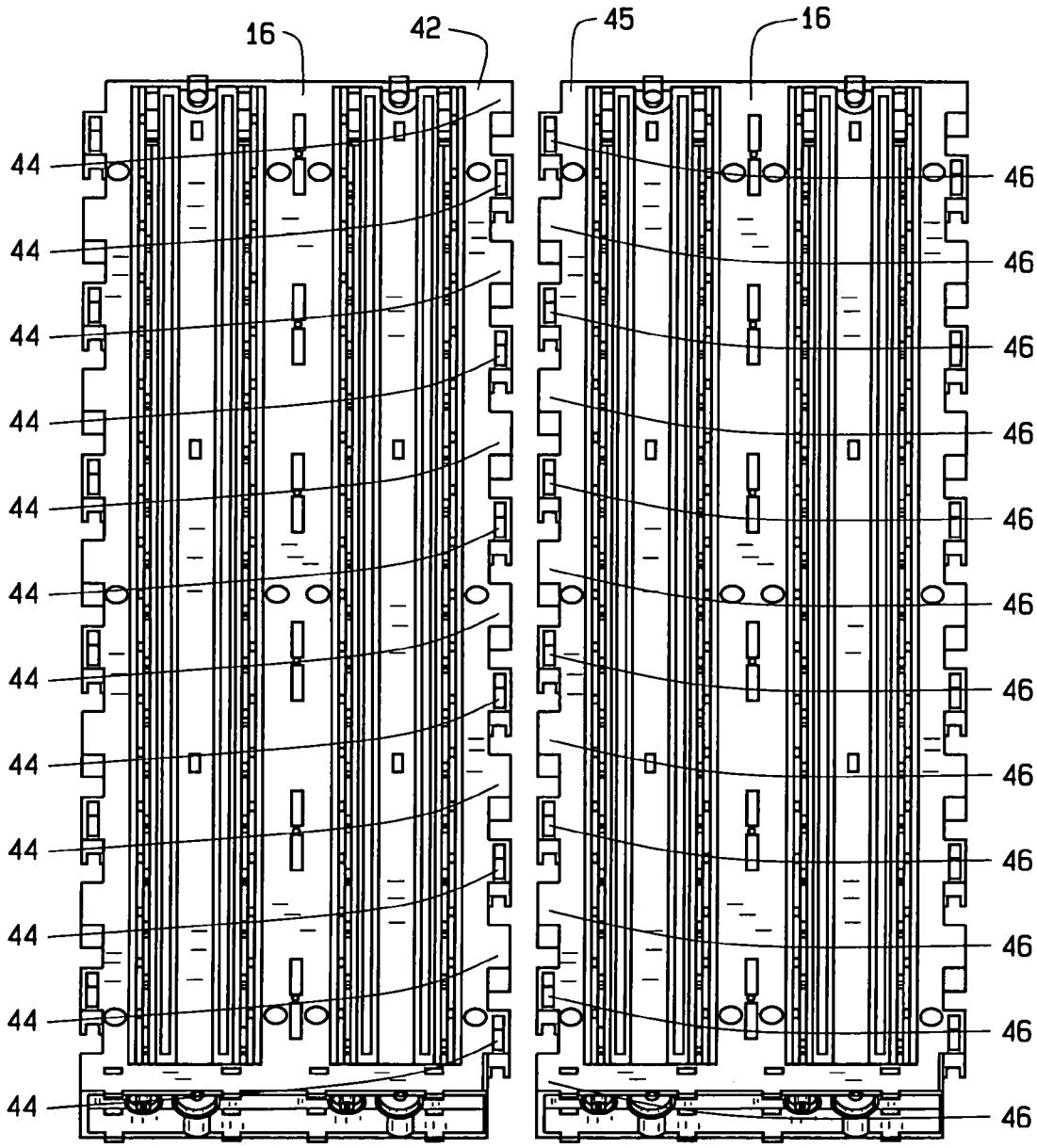
FIG. 5 is a front perspective view of two unattached vending machine trays according to an embodiment of the present invention.
Figure 6:
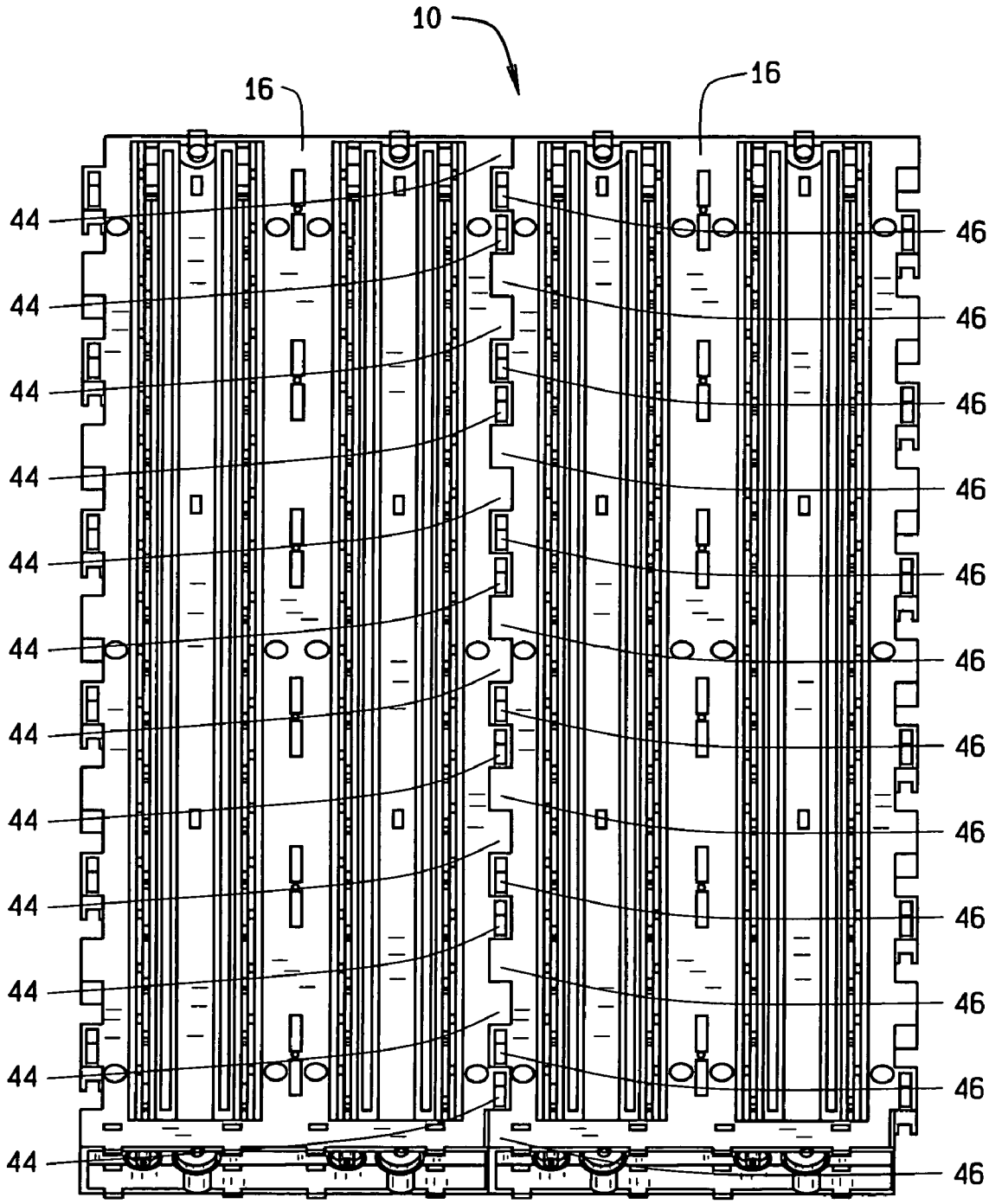
FIG. 6 is a front perspective view of two attached vending machine trays according to an embodiment of the present invention.

Referring to FIG. 5, the right side 42 of the base 16 defines interlocking fingers 44 and the left side 45 of the base 16 defines interlocking fingers 46. When the left side of a base 16 is brought next to the right side of another base 16 the fingers interlock such that the two bases 16 may be locked together to make a larger tray 10, as shown in FIG. 6.

In the preferred embodiment, the tray is comprised of two rows 12. Therefore, by locking the bases 16 together, a larger tray 10 comprised of any even number of rows 12 can be used within vending machines of various sizes. However, nothing should be construed to limit the invention any particular number of rows and more or fewer rows may be implemented within a tray without departing from the scope of the present invention, for example bases of only a single row that lock together to form a larger tray.

Figure 7:
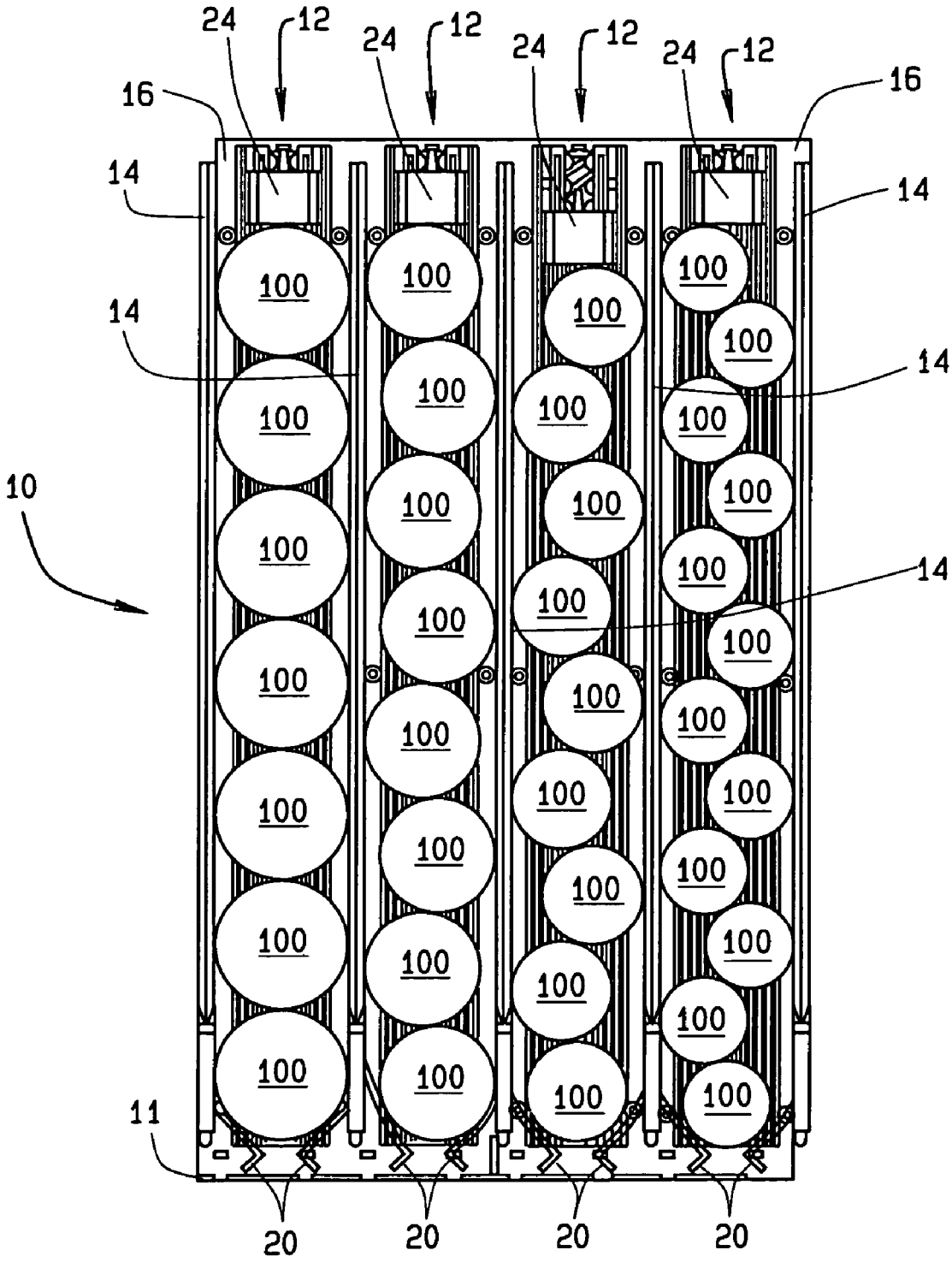
FIG. 7 is a top view of two attached vending machine trays having product loaded therein according to an embodiment of the present invention.

In order to use the device of the present invention, the bases 16 are interlocked together to form a proper width tray 10 suitable for a particular vending machine. Multiple rows of trays are further provided within the vending machine and the rows 12 of the trays 10 are filled with product 100 to be vended, as shown in FIG. 7. The product 100 may be of various sizes as large as the width of the row 12 or as small as slightly larger than half the width of the row 12. To maintain product near the front of the row, the product drive member 24 abuts the rearmost product 100 and the force provided by the spring 34 urges the product 100 within the row 12 against the resilient arms 20 at the front 11 of the tray 10. In this manner the product 100 awaits vending by the machine.

Figure 8:
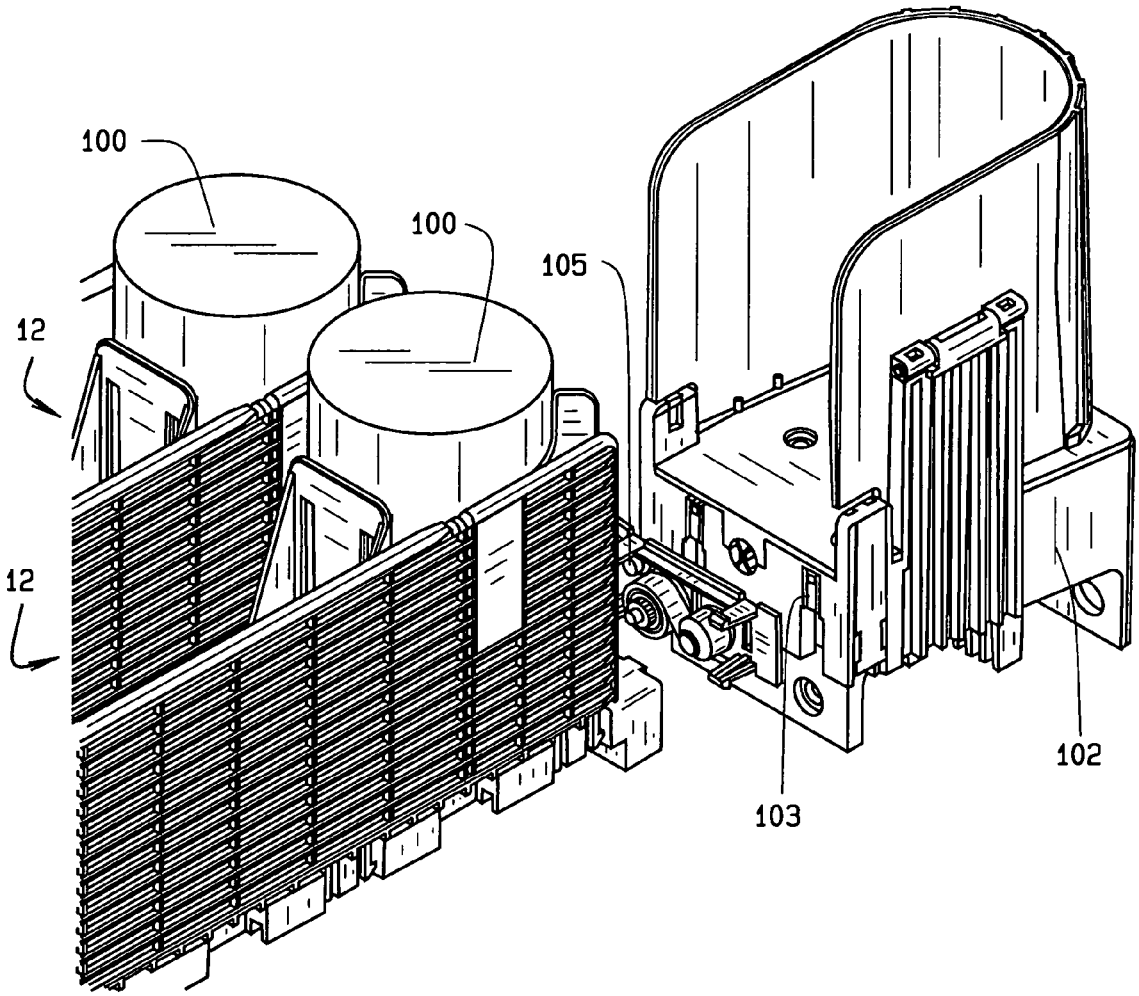
FIG. 8 is a rear perspective view of a partially assembled vending machine tray according to the embodiment of the present invention.
Figure 9:
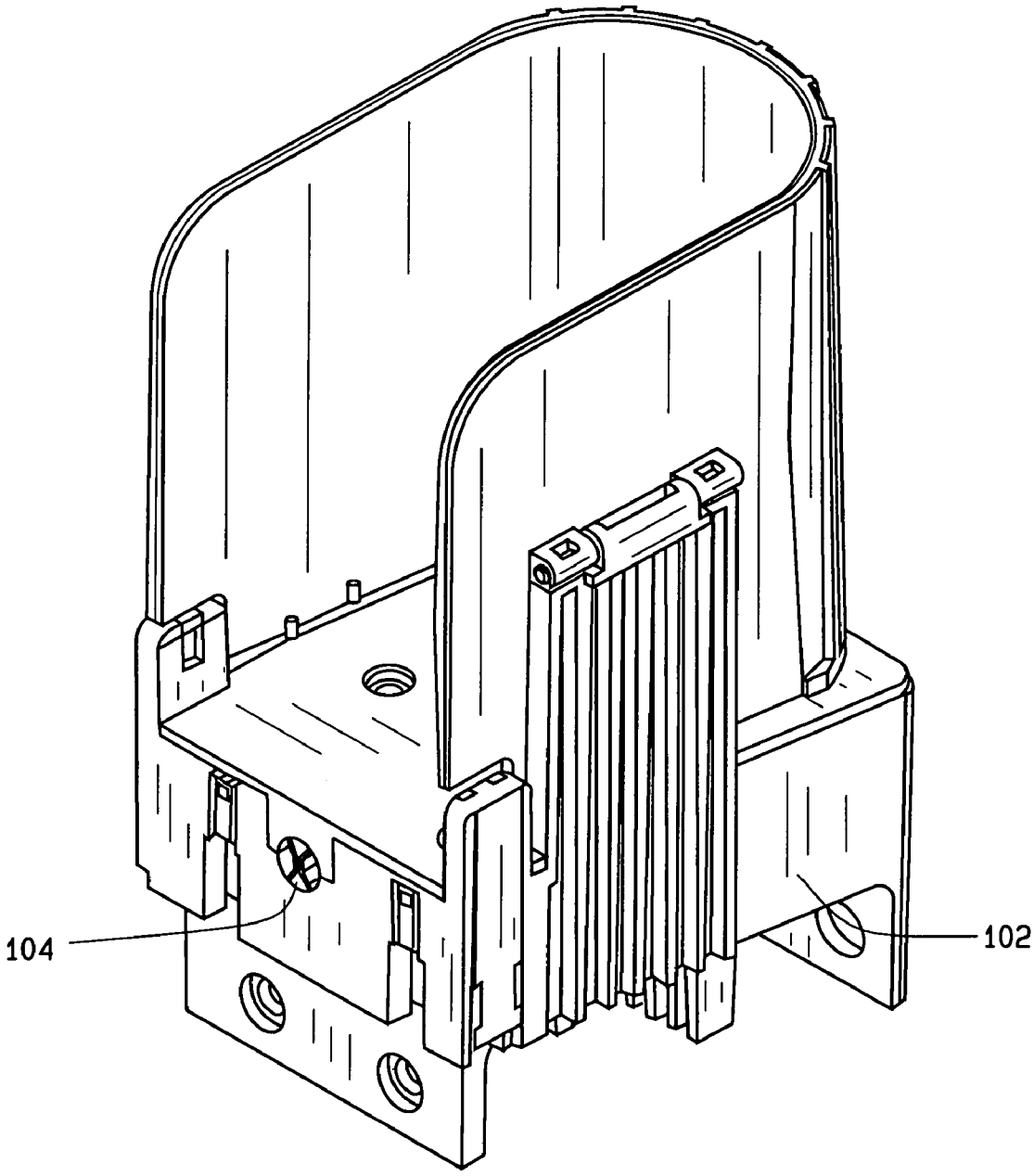
FIG. 9 is a partial view of an elevator for use with the tray of the present invention with the product dispenser drive retracted.
Figure 10:
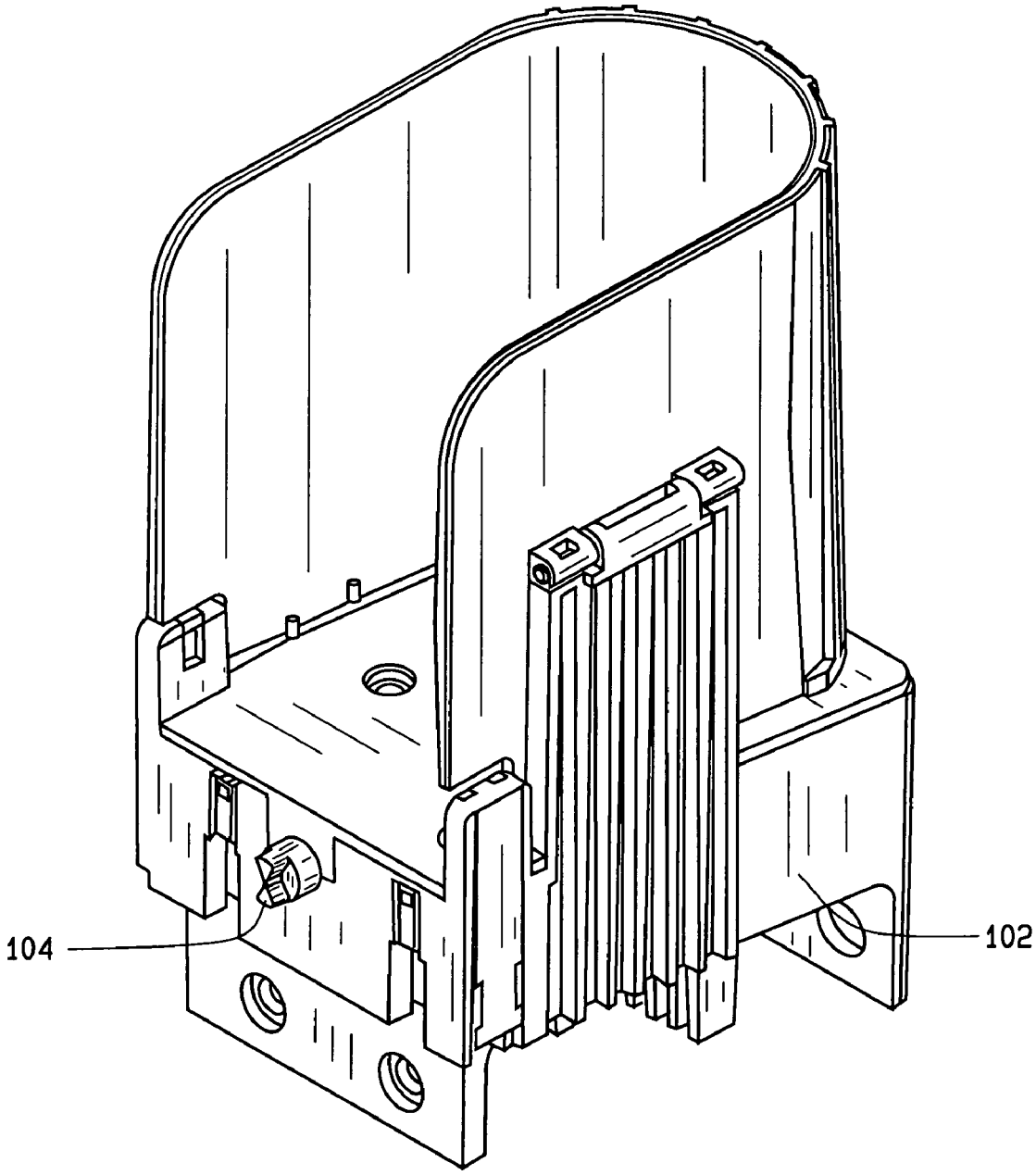
FIG. 10 is a partial view of an elevator for use with the tray of the present invention with the product dispenser drive extended.

When the time for vending the product 100 arrives, an elevator 102, as shown in FIG. 8, is moved to the desired product row 12 for vending. The elevator 102 comprises a cup for holding the vended product and transporting it to a customer pickup station (not shown). The elevator 102 determines the precise location of the product to be vended by first traveling to an expected location of the row 12 within the vending machine for the product. However, because the vending machine cabinet may have warped due to being placed on uneven ground or merely due to manufacturing tolerances, the expected location may not be the precise location of the row 12 containing the product to be vended. In order to find the precise location, the elevator 102 begins searching in the area of the expected location until a sensor 103 carried by the elevator 102, such as a Hall Effect sensor or a reed switch, locates an indicator 105, such as a magnet, such indicator 105 being located with respect to each row 12 location. Once the elevator has found the indicator associated with the row 12, an electromechanical device (not shown) within the elevator 102 extends a product dispenser drive 104 from a retracted position (FIG. 9) to an extended position (FIG. 10). The product dispenser drive 104 has a cooperating shape to that of the drive shaft 28 and mates with the drive shaft 28 to rotate it. As the drive shaft 28 is rotated by the elevator 102, the product drive member 24 forces product 100 toward the elevator 102 and past the resilient arms 20. Once the product 100 passes the resilient arms 20, it enters the elevator 102 and the product dispenser drive 104 of the elevator 102 stops rotating. The product dispenser drive 104 of the elevator 102 is then retracted and the elevator 102 takes the product 100 for dispensing to a customer.

Figure 11:
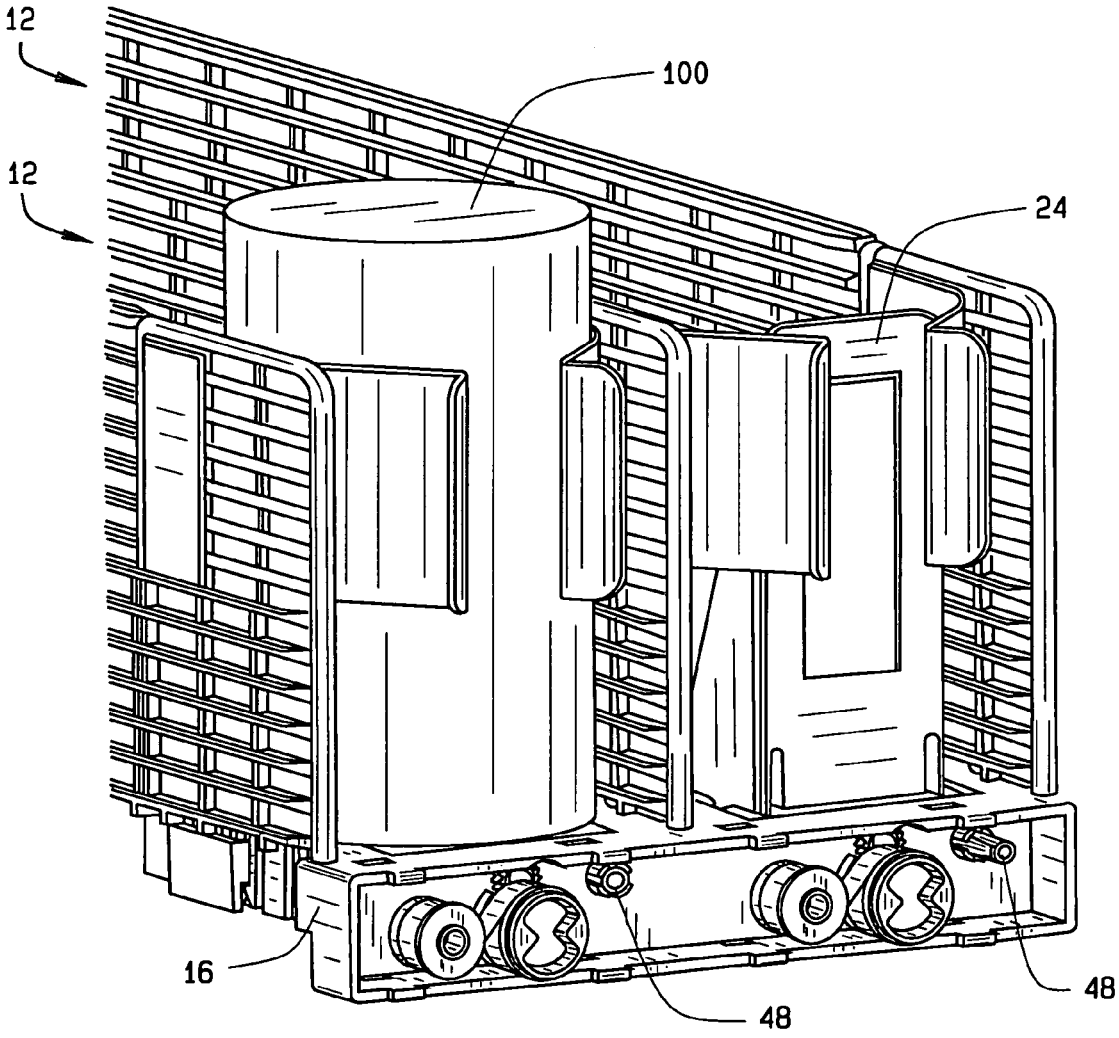
FIG. 11 is a front perspective view of a partially assembled vending machine tray with a product present indicator retracted and extended.

Optionally, a sensor 103 may be provided on the elevator that detects the presence of an indicator 48 with respect to the product drive member 24, as shown in FIG. 11. While product 100 is located within the row 12, the indicator 48 is retracted and not detected by the sensor. In this manner, the vending machine determines that product 100 remains in a particular row. When product 100 no longer is located within the row 12, the indicator 48 is extended and detected by the sensor, and thus detects the absence of product 100 before attempting to vend the product and alerts a consumer to make an alternate product choice.

Alternatively, rather than detecting the presence or absence of product directly, the product elevator 102 can attempt to vend product and if after a predetermined period of time no product 100 is dispensed, the vending machine will determine that no product is present within the row.

While the specific embodiments have been illustrated and described, numerous modifications come to mind without significantly departing from the spirit of the invention.

The invention claimed is:

1. A tray for a product vending machine comprising:

a flat base upon which product to be vended may be placed;

a plurality of walls attached to the base which define rows into which product is organized;

a channel within the flat base for housing a threaded shaft, the threaded shaft threadingly attached to a product drive member;

a mating surface associated with the threaded shaft such that when the mating surface is rotated, the product drive member is moved within the row wherein the mating surface is defined by a drive shaft comprising a gear that meshes with a gear of the threaded shaft to rotate the threaded shaft; and wherein the product drive member is adapted to be biased toward one end of the row by a linear coil spring that wraps around the drive shaft and around a spring shaft in an opposite direction as the drive shaft.

2. The tray of claim 1 further comprising at least one resilient arm attached to the tray and biased in a position that substantially blocks product from exiting a row, the resilient arm being adapted to resiliently deflect when the product drive member forces a product past the resilient arm so that the product may be vended and return to its initial position to block the next product in the row.

3. The tray of claim 1 further comprising a pair of resilient arms located at an end of each row and biased in a position that substantially blocks product from exiting the row, the resilient arms being adapted to resiliently deflect when the product drive member forces a product past the resilient arms so that the product may be vended and return to their initial position to block the next product in the row.

4. The tray of claim 1 wherein the product drive member is adapted to be biased toward one end of the row.

5. The tray of claim 1 wherein the base of the tray comprises sections defining the rows, the sections interlocking with one another such that additional rows may be added or removed as required.

6. The tray of claim 1 further comprising an indicator for indicating the location of a row.

7. The tray of claim 6 wherein the indicator is a magnet.

8. The tray of claim 1 associated with a elevator for moving to the location of a desired row, extending a rotatable product drive to mate with the mating surface, and rotating the product drive to rotate the threaded shaft to force the product drive member to drive product within the row past resilient arms into the elevator.

9. A tray for a product vending machine comprising:

a flat base upon which product to be vended may be placed;

a plurality of walls attached to the base which define rows into which product is organized; and a channel within the flat base for housing a threaded shaft, the threaded shaft threadingly attached to a product drive member;

a pair of resilient arms located at an end of each row and biased in a position that substantially blocks product from exiting the row, the resilient arms being resiliently deflectable to allow product to pass between the arms when product is forced past the arms;

a mating surface associated with the threaded shaft such that when the mating surface is rotated, the product drive member is moved within the row wherein the mating surface is defined by a drive shaft comprising a gear that meshes with a gear of the threaded shaft to rotate the threaded shaft; and wherein the product drive member is adapted to be biased toward one end of the row by a linear coil spring that wraps around the drive shaft and around a spring shaft in a opposite direction as the drive shaft.

10. The tray of claim 9 wherein the product drive member is adapted to be biased toward one end of the row.

11. The tray of claim 9 wherein the base of the tray comprises sections defining the rows, the sections interlocking with one another such that additional rows may be added or removed as required.

12. The tray of claim 9 further comprising an indicator for indicating the location of a row.

13. The tray of claim 12 wherein the indicator is a magnet.

14. The tray of claim 9 associated with a elevator for moving to the location of a desired row, extending a rotatable product drive to mate with the mating surface, and rotating the product drive to rotate the threaded shaft to force the product drive member to drive product within the row past resilient arms into the elevator.

* * * * *